United States Patent [19]

Good

[11] 4,026,204

[45] May 31, 1977

[54] PRESS BLOCKING AND AIR LOGIC CONTROL SYSTEM

[75] Inventor: Maurice James Good, Oscoda, Mich.

[73] Assignee: Starboard Industries, Inc., Birmingham, Mich.

[22] Filed: Mar. 22, 1976

[21] Appl. No.: 669,392

[52] U.S. Cl. ..... 100/53; 72/26; 100/99; 100/269 R; 100/282; 192/131 R; 425/153

[51] Int. Cl.[2] ..... B30B 15/00

[58] Field of Search ..... 100/53, 99, 229 R, 269 R, 100/282; 83/DIG. 1, 397, 544; 425/151, 152, 153; 72/25, 26; 192/129 R, 131 R, 129 B

[56] References Cited

UNITED STATES PATENTS

| | | | |
|---|---|---|---|
| 2,240,630 | 5/1941 | Stacy | 100/53 |
| 2,946,277 | 7/1960 | Archer | 100/53 |
| 2,962,633 | 11/1960 | Raymond | 100/53 |
| 2,990,578 | 7/1961 | Adair | 100/53 |
| 3,359,598 | 12/1967 | Bucy | 100/53 |
| 3,446,106 | 5/1969 | Ferris | 100/229 R |
| 3,446,985 | 5/1969 | Carlisle | 192/131 |
| 3,452,618 | 7/1969 | Nagele | 100/53 |
| 3,541,950 | 11/1970 | Anderson | 100/53 |
| 3,554,067 | 1/1971 | Scutella | 100/53 |
| 3,628,357 | 12/1971 | Luenser | 100/53 |
| 3,650,650 | 3/1972 | Cook | 425/153 |
| 3,749,005 | 7/1973 | Einecker | 100/53 |
| 3,815,456 | 6/1974 | Braathen | 100/53 |
| 3,832,875 | 9/1974 | Newman | 100/53 |
| 3,884,336 | 5/1975 | Williamson | 192/131 R |

FOREIGN PATENTS OR APPLICATIONS

| | | | |
|---|---|---|---|
| 1,232,693 | 10/1960 | France | 100/53 |
| 6,905,597 | 10/1970 | Netherlands | 100/53 |

*Primary Examiner*—Billy J. Wilhite

[57] ABSTRACT

The press blocking and air logic control system of this invention embodies a press ram blocking apparatus and air logic circuitry and control means in combination for moving a ram blocking member into ram stopping position thereunder upon the occurrence of one or more events justifying blocking of the press ram, to prevent injury or damage to personnel or equipment which would expectedly result from inadvertence, error or accident. The air logic control circuitry for the blocking device is connected to and in association with conventional press circuitry for the press ram actuating mechanism. For normal press operation, the ram blocking member is retained in retracted position by its air logic control circuitry.

20 Claims, 8 Drawing Figures

PRESS BLOCKING AND AIR LOGIC CONTROL SYSTEM

A disclosure of a press ram blocking apparatus in combination with an electrical system including electronic circuitry and control mens has been made in the co-pending application of Good et al Ser. No. 614,749, filed Sept. 19, 1975, and entitled "Press Blocking and Control System" now U.S. Pat. No. 3,999,477. The instant application is a further improvement and developement of the system therein disclosed.

SUMMARY OF THE INVENTION.

The invention pertains to a press blocking and control system embodying a blocking device for insertion between the press ram and the die bed responsive to inadvertence, error or accident in press operation, to prevent movement of the press ram into substantial contact with the lower die or bolster plate, whereby injury may be caused to press operating personnel or damage to tooling in the press ram and die bed. The press ram blocking member is actuated for advanced and retracted movement by a fluid cylinder controlled by a 4-way pivot valve admitting fluid to and discharging fluid from the cylinder. The 4-way valve is controlled for operation by an air logic system of fluid valves in an air logic circuitry for admitting compressed air to the fluid cylinder.

The mechanical apparatus including the press ram blocking device, the fluid cylinder and control valve therefor are suitably mounted on the press for movement of the blocking device into ram blocking disposition upon the lower die plate. Conventional means for supporting the mechanical apparatus and components are utilized for mounting the same on the press.

The air logic control circuitry of the inventive system is connected by conduits to a source of compressed air and to the 4-way pivot valve actuating the fluid cylinder, the components comprising the control circuitry being preferably housed in a container mounted upon the press in a position accessible to the press operator or maintenance service personnel. The air logic control circuitry embodies means responsive to press operation whereby incorrect or inadvertent operation of press control devices results in actuation of the blocking member into press ram blocking position.

GENERAL DESCRIPTION

The press blocking and control system of this invention embodies several features for personnel and machine safety. The press ram blocking apparatus embodies a movable adjustable blocking member, preferably of steel, that is removably insertable between the upper movable press ram or its supported upper tool holding bolster plate and the lower bolster or die plate. As an example of its operation, in an air clutch operated press having a three inch stroke, operating at a speed of two strokes per second, should a malfunction occur, the blocking device will be disposed under the press ram in less than one inch of ram stroke. Under these conditins, by virtue of the blocking device, at least two inches remain open under the press ram to provide ample safe space for the press operator's hands.

In another aspect, the inventive system shuts the electrical power off to the machine after the control system senses a double or continuous action malfunction, combining normal braking action in the press with disposition of the blocking member under the press ram. In addition, press and machine tool damage are reduced or substantially eliminated when the system of the invention is activated, by removing clutch power so that the press ram drops onto the stop block with little or no force.

In the exemplary embodiment of the invention described herein, the press operator must maintain full pressure of bothe hands on the press operating palm run buttons until the press stroke has gone through at least 180° of its single stroke cycle, thus reducing the possibility of the press ram "bottoming out". The control system's circuitry is connected in and to the press circuitry of which the palm buttons form a part.

In the event that the press is arranged for continuous operation, or inching operation as for tool set-up, the inventive system can be de-activated, at which time a visual warning signal is illuminated. In addition, the inventive system embodies its own "test safe" circuitry, indicating the system's reliability for meeting and responding to a malfunction of the press, tooling set-up or maintenance. Further, the circuitry has its own independent air control device, independent of the press motor starting relay, so that the press ram blocking system operates independently of the press drive. Other control and visual signals are embodied in the control system to assure and insure that control devices, such as limit switches, are functioning properly.

The important advantage of and the primary purpose for the press ram blocking and control system of this invention is the prevention of injury and damage to press operating personnel and equipment.

DRAWINGS

Various further and more specific objects, features and advantages of the invention will appear below, taken in connection with the accompanying drawings, illustrating an exemplary embodiment of the invention. Reference is here made to the drawings annexed hereto and forming an integral part of this specification, in which FIG. 1 is a side elevational view of an air clutch operated press embodying, in an exemplary form, mechanical press ram blocking and control system components of the invention.

DETAILED DESCRIPTION

Figure 1:
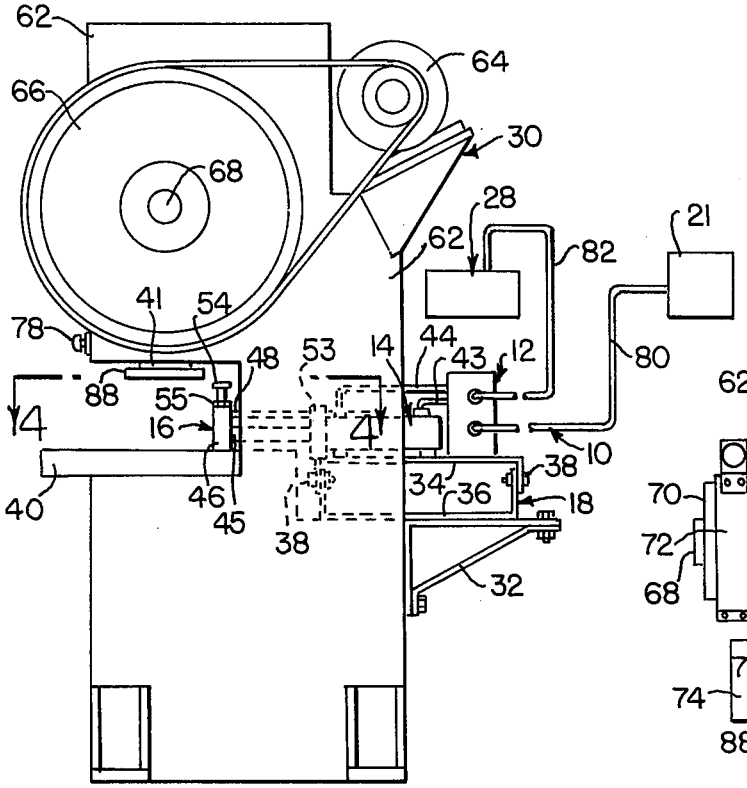
Figure 2:
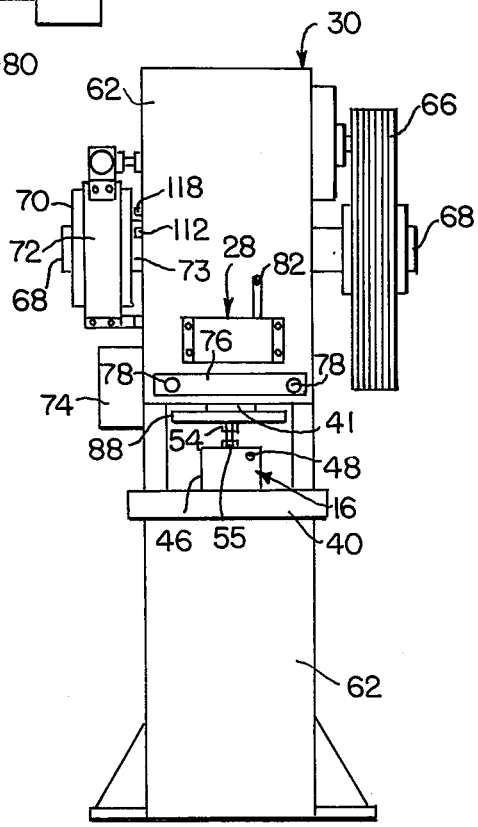
FIG. 2 is a front elevational view of the press, the press ram blocking and control system components illustrated in FIG. 1.
Figure 3:
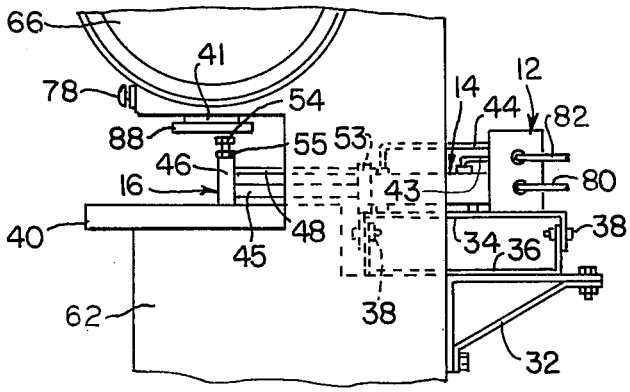
FIG. 3 is a fragmentary side elevational view corresponding substantially to the same portion of the press and press ram blocking apparatus illustrated in FIG. 1, the blocking device being shown in press ram bolster plate stopping position.

An exemplary embodiment of the invention described herein and illustrated in the several views of the drawings comprises a press ram blocking apparatus 10 as a part of and in conjunction with the air logic control circuitry 20.

The apparatus 10 comprises an air operated spring loaded 4-way pivot valve 12, an air cylinder 14, a press ram blocking device 16 adjustable as to height and connected to the piston rod of the air cylinder, and an apparatus support device 18 upon and to which the valve and air cylinder are secured. The apparatus 10 may be secured directly to the press framing if such mounting is practical or feasible, depending upon the structural features of the press. Components and elements of the air logic circuitry 20 are housed in a suitable compartment affixed to the press framing and communicating with a source of compressed air 21 and the air cylinder 14.

The ram blocking device 16 is mounted for actuation and movement of the ram blocking component into and out ofpress ram stopping position, between the lower bolster or die plate and the upper movable ram and/or its bolster plate or tooling support plate.

The air logic control circuitry 20 is conduit connected to and communicates with the air source 21 which is normally located at a position remote from the apparatus 10. Air logic components of the circuitry 20 are housed in the container or case 28 preferably mounted upon the press framing in a position readily accessible to the press operator or to service and maintenance personnel.

As illustrated particularly in FIGS. 1–4, the apparatus 10 and air logic circuitry 20 in case 28 are mounted upon the framing of air clutch operated press 30. A bracket 32 for the support device 18 is disposed on the press framing at an elevation and in a location permitting the press ram blocking device 16 to function in ram stopping disposition upon its forward actuation by the air cylinder piston rod. It will of course be understood by persons skilled in the art to which the invention pertains that the location for mounting and securement of the apparatus 10 may vary from press to press.

The support members 18 comprise a pair of upper and lower channel-type plates 34, 36 respectively, arranged in opposing relationship and secured together at their vertical legs by suitable fasteners 38, whereby the apparatus 10 can be elevated into and supported in alignment with the upper surface of the lower die or bolster plate 40 of the press, and below the press ram 41 when at the upper end of its stroke.

Fixedly mounted and secured upon and to the upper supported plate 34 are the 4-way pivot valve 12 and the air cylinder 14. The valve 12 is served with a supply of compressed air directly from the source 21 and with compressed air admitted thereto by an element of the control circuitry 20. The air source 21 may be the same source that furnishes air for the press air clutch operation, or it can be an independent source of compressed air serving only the blocking apparatus 10 and control circuitry 20 of this system. The 4-way pivot valve 12 communicates by conduits 43, 44 with the piston chamber of the air cylinder 14 for operative movement of its piston and piston rod 45, the distal end of which fixedly secured to the press ram blocking member 46.

Figure 4:
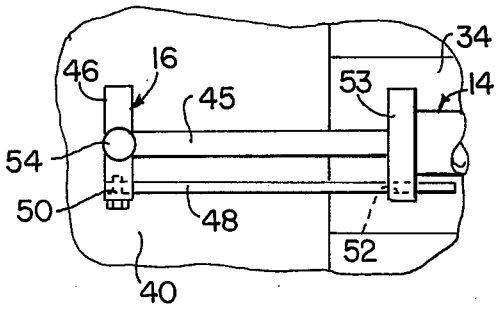
FIG. 4 is a fragmentary top plan view on a slightly enlarged scale of the press ram blocking device and a portion of its associated actuating fluid cylinder, taken substantially on the line 4—4 of FIG. 1.

As illustrated more particularly in the slightly enlarged view of FIG. 4, the blocking member 46 is guided for upright, non-rotating movement by the slide guide rod 48 fixedly secured at its forward end by a pin 50 to the blocking member 46 and slidable in a bearring 52 arranged as a part of or attached to one end plate 53 of the air cylinder 14. The blocking device 46 is made adjustable as to height by means of the screw 54 which is threadedly mounted into the upper portion of the blocking memberr 46. A lock nut 55 threaded on the screw is adapted to lock the screw to the member 46 in its adjusted position.

The air clutch operated press 30 normally comprises in part a frame 62, a motor drive 64 belt-connected to a flywheel 66 mounted for rotation upon one end of a shaft 68 extending transversely through the frame and having a drum 70 mounted on its other end adapted for engagement by an air cylinder operated brake device 72 supported upon the frame 62. The shaft 68 also mounts a cam 73 which serves to actuate limit switches 118 and 128 forming a part of the circuitry 20. A third limit switch 112 is also mounted upon the frame 62 in association with and for actuation by the cam 73. A crank (not shown) mounted subdtantially central on the shaft 68 is connected to and drives the press ram 41 in substantially vertical reciprocating movement.

Conventional electrical controls for electrical actuation and operation of the press are embodied on a panel board or in a box 74 which contains conventional circuit control means for the panel 76 mounted on the front of the press framing for more facile operator access. The panel 76 is arranged with a pair of palm buttons 78,78 adapted to be manually actuated by the press operator. The circuitry in which the buttons and their switches are connected requires that both palm buttons 78,78 must be depressed substantially simultaneously to close the circuit to the press drive 64, and that both palm buttons be maintained in fully depressed position until at least 180° of the ram stroke has been effected. Thereafter, the palm buttons can be released and the stroke will complete without actuation of the ram blocking apparatus 10.

One side of the 4-way pivot valve 12 is supplied with compressed air by conduit 80 directly connected to and communicating with the air source 21. A second conduit 82 serving the valve 12 is connected to and communicates with the circuitry 20 housed in the case 28.

The press ram 41, driven by the flywheel 66 and shaft 68, is provided with an upper tooling support or bolster plate 88 adapted to support tooling complementary to and cooperating with a die set mounted in the lower die bed or bolster plate 40, according to conventional practice. Tooling and die sets are infinitely variable in construction and are not shown in the drawings.

Figure 9:
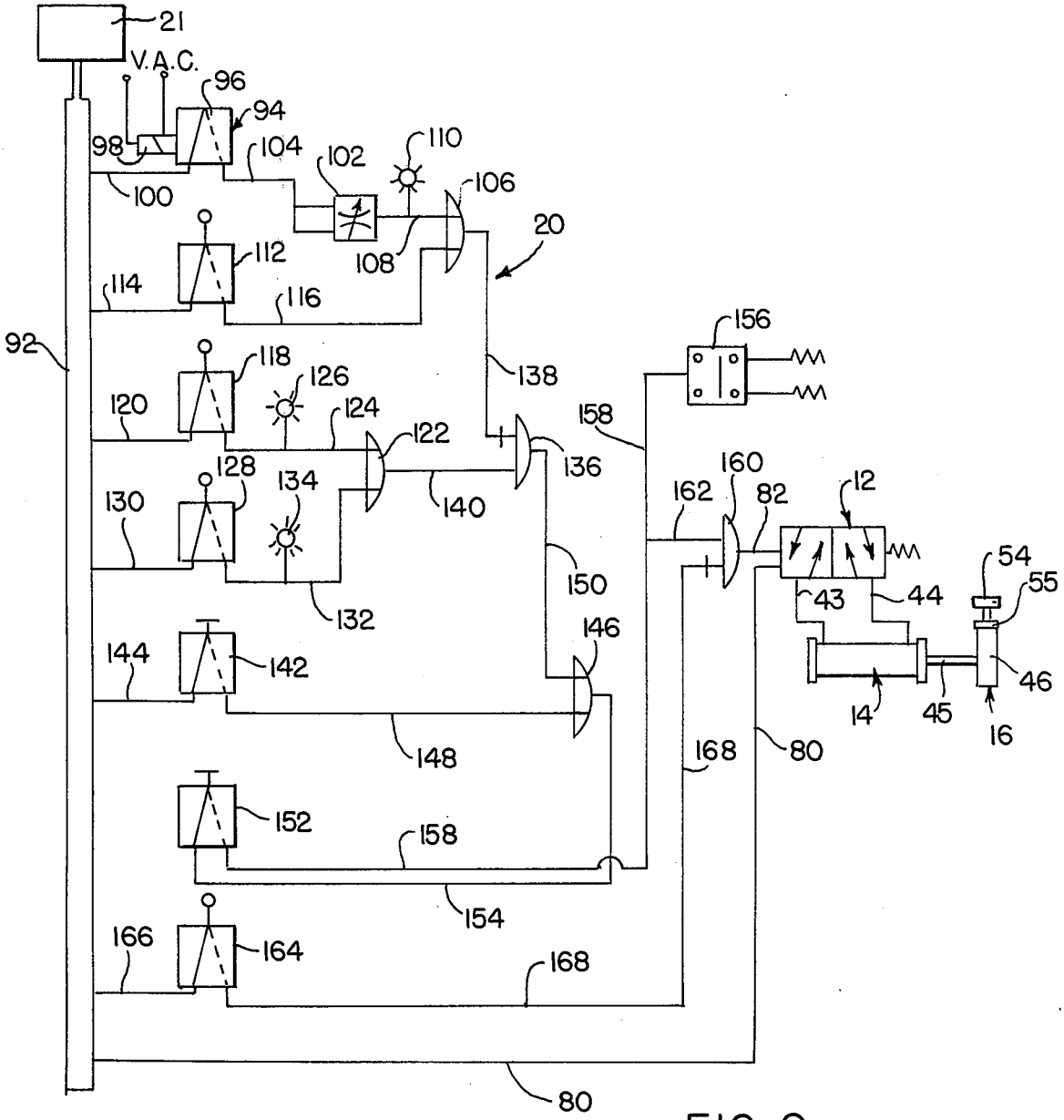
FIG. 9 is a diagrammatic view of an exemplary air logic control circuitry for the system of the invention described and illustrated herein.

The air logic control circuitry 20 (FIG. 9) comprises the compressed air source 21, a manifold 92 conduit connected to and communicating with the air source and a plurality of air operated switches served by, conduit connected to and communicating with the manifold. The solenoid operated air switch 94 comprises the air valve portion 96 and the solenoid portion 98 operated electrically from and by a source of suitable electrical power. Air is supplied to the valve portion 96 by conduit 100 connected to the manifold 92. The switch air valve portion 96 communicates with a negative output variable air timer 102, adjustable for output of compressed air at a speed in the range of from 0 to 20 seconds, by the conduit 104. The output side of the timer 102 is connected to a first OR element 106 by conduit 108, and an airflow indicator lamp 110 is connected in the conduit 108 to signal the presence of pressurized air in the conduit.

A first limit switch 112, mounted upon the press framing in association with and for actuation by the cam 73, is connected by conduit 114 with the manifold 92 and communicates with the OR element 106 by conduit 116. A second limit switch 118 is connected by conduit 120 with manifold 92 and communicates with a second OR element 122 by conduit 124. An airflow indicator lamp 126 is connected in conduit 124 to signal the presence of pressurized air in the conduit. A third limit switch 128, a back-up for switch 118, is connected by conduit 130 with manifold 92 and communicates with the OR element 122 by conduit 132. Limit switches 118 and 128 are mounted on the press frame 62, in association with and for actuation by the cam 73, in a substantially parallel aligned relationship for simultaneous actuation. An air flow indicator lamp 134 is connected in conduit 132 to signal the presence of pressurized air in the conduit. The first and second OR elements 106 and 122 are connected to and communicate with the NOT element 136 by conduits 138 and 140 respectively.

A first manually operable test air switch 142 is connected by conduit 144 with the manifold 92 and communicates with the OR element 146 by conduit 148. The NOT element 136 communicates with the OR element 146 by conduit 150. A second manually operable test air switch 152 is served by pressurized air discharged from the OR element 146 through conduit 154. Manual actuation of the test switch 152 discharges pressurized air to the air operated pressure switch 156 through conduit 158 connected thereto and to the NOT element 160 by branch conduit 162. The pressure switch 156, upon the presence of at least a predetermined air pressure, such as 4 psi, in conduit 158, is actuated to close the emergency off path circuit in the electrical press control. The switch 156 is also provided with a manual override and a pressure check button. A fourth limit switch 164 is connected by conduit 166 with the manifold 92 and communicates with the NOT element 160 by conduit 168. This limit switch is also mounted on the press framing in association with and for actuation by the cam 73. The discharge side of the NOT element 160 is connected to the 4-way pivot valve 12 by conduit 82.

The limit switches 112, 118, 128 and 164 are preferably cam roller operated air switches, although other suitable types of air operated limit switches may also be used depending upon the construction and characteristics of the press and its related ram actuating components. The pneumatic indicators or lamps 110, 126 and 134 show when pressurized air is present in their respective lines and are readily visible from most every angle.

The 4-way pivot valve 12 is a spring operated valve. When pressurized air is passed to the valve by the NOT element 160, the input side of the valve charges air into the air cylinder 14, overcoming the resistance of the spring loaded valve spool and driving the piston and its piston rod 45 forward to position the blocking device 16 under the ram supported bolster plate 88. Upon closing of the element 160, the spring in the valve 12 shifts the valve spool therein to charge air into the reversng or forward side of the air cylinder piston to retract the ram blocking device 16.

In single stroke operation, upon normal actuation of the electrical switches under the palm buttons 78,78, 115 volt alternating current is supplied from the press electrical control box 74 to the air switch solenoid 98. This voltage is required to initiate operation of the air logic circuitry 20 and for the first 180° of ram movement from the top of its stroke. The actuation of solenoid 98 opens the air switch 94 and passes pressurized air to the timer 102 and to the OR element 106. Since the timer 102 is a negative output air timer, after the preset time delay has occurred, airflow stops at the timer which remains open until the timer is reset by a supply of air from the switch 94. When air pressure is not present in conduit 108, the visual indicator 110 is not actuated.

With rotation of the press cam 73, mounted on the crankshaft 68, through 180° of its revolution, the cam operated air operated limit switch 112 is actuated, allowing air to be applied through conduit 116 to the OR element 106. With an input from the timer 102 and the air switch 112, air is passed to one side of the NOT element 136 by way of conduit 138. As the press cam 73 rotates through its first 180° of revolution, it actuates the parallel aligned air limit switches 118 and 128, positioned on the press framing at 30° of such revolution from the top of the ram stroke, causing air to pass through conduits 124 and 132 to the OR element 122. With air pressure at either side of the OR element, it will open and pass air to the NOT element 136 through conduit 140. With an input from the OR element 122 and an input from the OR element 106, the NOT element 136 will not open. Consequently, air will not pass to the OR element 146 by conduit 150.

The test air switch 142 is manually operable and is used to test the reliability of the circuitry 20, or to check the ram operation during periods of maintenance or tool set-up in the press. Upon manual actuation of the test switch 142, air is supplied to the OR element 146, causing air to flow through the air switch 152 to the NOT element 160 and to the 4-way pivot valve 12, actuating the air cylinder 14 and moving the ram blocking device 16 into ram stopping position on the die set bolster plate 40.

Test switch 152, when charged with pressurized air from the OR element 146, de-activates the blocking system, if the inch, continuous or reversing press control elements are actuated, opening the test switch and breaking the airflow to the NOT element 160.

The pressure switch 156, upon actuation by air pressure discharged from the test switch 152, breaks the electrical emergency off-path circuit, shutting down power to the motor drive 64.

The air limit switch 164, mounted on the press framing 62 in association with the cam 73, is activated by the cam during its rotation of from 90° to 330° of the ram stroke. Its purpose is to keep the ram blocking device 16 from striking the ram or its supported upper bolster plate 88 in the event that a malfunction occurs during the 90°–330° portion of the stroke. Should a malfunction occur during this period, the pressure switch 156 would be actuated by the air switch 152, causing the normal press braking device 72 to operate upon the drum 70. Whether or not air pressure is present in conduit 168 at the NOT element 160, there would be no output from the element unless air pressure is also present in conduit 162 at the element. If there is no output from the NOT element 160, there will be no air pressure in conduit 82 to actuate the 4-way pilot valve 12.

When a pilot air pressure is applied to the valve 12, the valve spool shifts internally and the main air supply from source 21 shifts from the forward portion of the air cylinder 12, ahead of the piston, to the rear portion behind the piston, driving it and its piston rod 45 forwardly and positioning the ram blocking device 16 under the ram supported bolster plate 88.

In the event of a malfunction, there would be no air pressure in conduit 138 ahead of the NOT element 136, but air pressure would be present in conduit 140, causing NOT element 136 to function and pass pressurized air through the element and the OR element 146, the test switch 152 and the NOT element 160, activating the 4-way pilot valve 12.

An air clutch operated press has been described above and illustrated in FIGS. 1–4 inclusive. The invention, however, is not limited to utilization only in such press, but can be used in hydraulic, air cylinder and other similar types of presses, two of which are shown generally and representatively in FIGS. 5–8.

Figure 5:
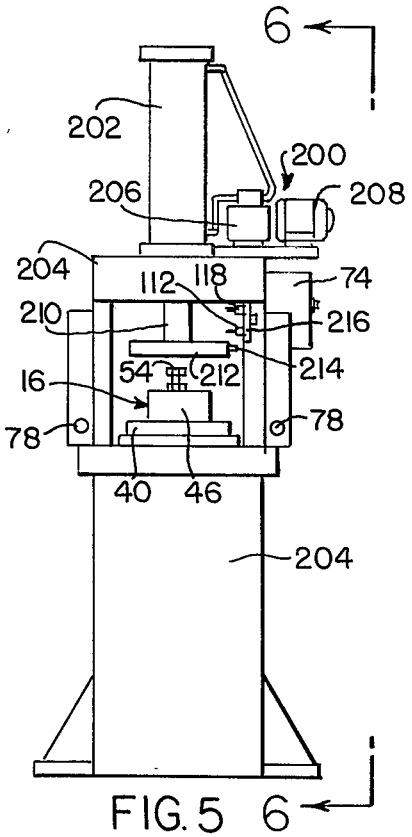
FIGS. 5 and 6 are front and side elevational views respectively of a hydraulic-type press embodying the exemplary form of the invention.
Figure 6:
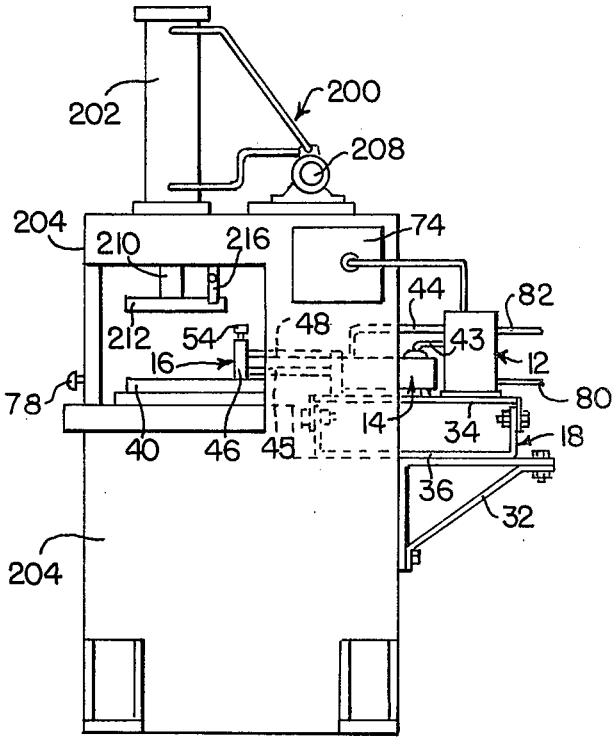

The press illustrated in FIGS. 5 and 6 represents generally a hydraulic type press 200 having a hydraulic cylinder 202 mounted on a press frame 204, the hydraulic fluid for the cylinder being delivered by a pump 206 operated by motor 208 from a suitable source (not shown). The hydraulic cylinder ram 210 is provided at its distal end with a tool-holding bolster plate 212 attached thereto and having an air switch tripping finger 214 extending laterally for engagement with the air limit switches 118, 128 and 164 of the circuitry 20. These limit switches are mounted upon a vertically adjustable post 216 secured to the framing 204. Such vertical adjustment is designed to accommodate the stroke and speed of the press ram for effective operation of the ram blocking device 16 which is mounted in the press 200 in the same relationship as that disclosed for the press 30. The press 200 is also providing with palm buttons 78, 78 or similar press actuating means in the press control circuitry similar to that utilized for the press 30.

Figure 7:
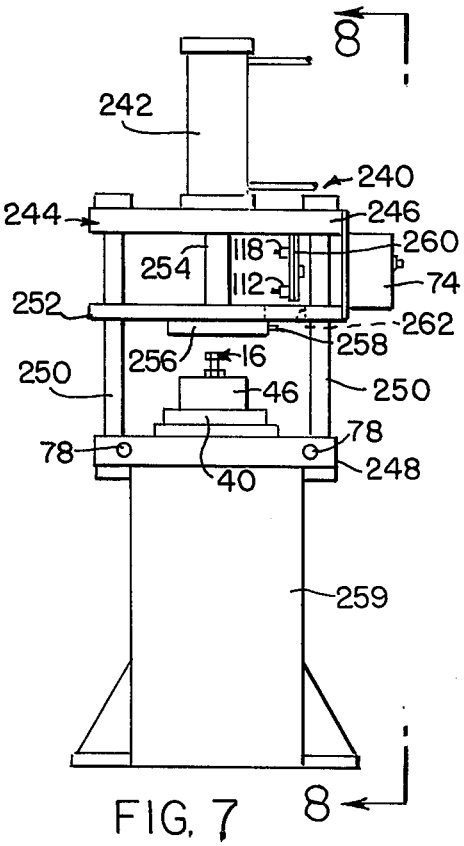
FIGS. 7 and 8 are front and side elevational views respectively of an air cylinder-operated press embodying the exemplary form of the invention.
Figure 8:
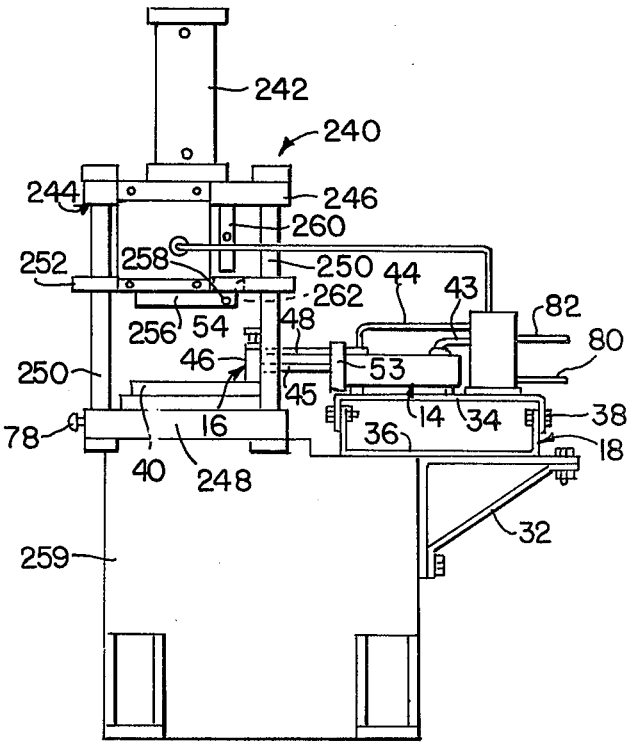

The air cylinder press 240, illustrated in FIGS. 7 and 8, generally comprises the air cylinder 242 mounted upon upper framing 244 having an upper plate 246 and a lower plate 248 conjoined by four columns 250 serving as guide posts for the vertically movable ram plate member 252 secured to the distal end of the air cylinder piston rod 254 and supporting the upper tooling bolster plate 256 to which a limit switch trigger 258 is mounted in lateral posture. The upper framing 244 is mounted upon a press stand 259. The piston rod 254 is considered to be substantially the equivalent of the ram of air clutch press 30 and the ram 210 of hydraulic press 200.

The air cylinder 242 is served and actuated by compressed air from a source (not shown) and is controlled by a valve system responsive to press control circuitry similar to that which is utilized with the presses 30 and 200. Such circuitry also embodies the palm buttons 78, 78 or similar manual press actuating means for the cylinder piston and piston rod 254 to move the ram member 252 and the upper bolster plate 256 vertically on the columns 250.

As in the case of the hydraulic press 200, the limit switches 118, 128 and 164 of the circuit 20 are mounted upon a vertically adjustable post 260 secured to the upper framing member 246. The vertically movable plate member 252 is provided with an opening 262 therethrough for admission of the post support member 216 and the limit switches mounted thereon during vertical travel of the plate member. The triggering pin or member 258 mounted on the upper bolster plate 256 is arranged to move in a path whereby the air limit switch rollers or pins will be engaged upon vertical travel of the ram plate member 252.

The ram blocking member 16 and air cylinder 14 are mounted on the press 240 in a manner similar to that disclosed for attachment to and operation in the presses 30 and 200.

Although the triggering mechanism for air limit switches 118, 128 and 164 in presses 200 and 240 is substantially the same, it is to be understood that, in the operation of the circuitry 20, it makes little difference whether the triggering devices 214 and 258 are mounted on bolster plates 212 and 256, or on rams 210 and 254 respectively. For this functional operation, the ram and the bolster plate can and should be considered as one.

Operation

The system apparatus 10 and circuitry 20, for the press 30, operate as follows.

To check the circuitry 20 and apparatus 10 for operability, the test switch 142 is manually actuated, passing compressed air to the OR element 146, the test switch 152, the NOT element 160 and the pressure switch 156. Since the limit switch 164 is not actuated, the NOT element 160 operates to pass compressed air to the valve 12 which discharges air to the cylinder 14, driving the piston and its rod 45 forwardly with its attached projecting blocking member 46 into ram blocking position, as in FIG. 3.

In the event that either of the air limit switches 118 and 128 in parallel, which are back-up one for the other, should close for any reason between 30° and 330° from top center of the crankshaft cam 132, air will pass to the NOT element 136, causing it to open and pass air from the conduit 150 to the OR element 146, the test switch 152 and NOT element 160 and pressure switch 156. Since the limit switch 164, at the 180° position of the ram stroke, may or may not be actuated, one of two conditions will occur. If the ram stroke causes the cam 73 to actuate the limit switch 164 but not complete a 330° revolution, the NOT element 160 will not pass air to the 4-way valve 12. If limit switch 164 is not activated, the NOT element 160 will pass air to the valve 12, activating the air cylinder 14 and blocking the ram bolster plate 88.

If the emergency off path circuit in the press controls is broken, the press is no longer in "drive" condition and no additional energy is imparted to the flywheel 66. In such event, the pressure switch 156 will close in response to air pressure in the conduit 158. The NOT element 160 will pass air to the valve 12, and the air cylinder 14 will be activated, whereupon the blocking device 16 will effectively hold the press ram upper bolster plate 88 from the lower die set bolster plate 40.

Normally the press holding relay coil in the press control circuit is energized when the palm buttons 78, 78 are pressed and their switches closed. Solenoid 98 is activated every time the palm buttons 78 are depressed, opening air swithc 96. But should the palm buttons not be pressed substantially uniformly and simultaneously, and held for at least 180° of the ram stroke, and released before the limit switch 112 is actuated, the preset time interval of timer 102 will run out, and no air will be passed to the NOT valve 136 through the OR valve 106 and conduit 138. In such event, indicator 110 will not come on, as a visual indication that air has not passed. But air will pass through the NOT valve 136 from limit switches 118 and 128, if and when the press cam 73 has rotated at least 30° from the top of the ram stroke. Under these conditions, should the press crankshaft cam 132 rotate more than 30° from top center, air limit switches 118 and 128 will open, passing air to the OR element 122 and to the NOT element 136. The ram blocking member 46 will thereupon be projected forwardly under the ram bolster plate 88, unless the palm buttons 78,78 are released between 60° and 180° of crankshaft rotation. Should they be so released, the air limit switch 164 will open and the ram blocking member 46 will not be projected forwardly. Moreover, the press drive control will be shut off by virtue of air pressure in conduit 158 to the pressure switch 156, breaking the emergency off-path circuit in the press controls. Normal press braking action will then occur.

Air limit switches 118 and 128 are preset on the machine frame 62 in association with the crankshaft cam 132 so that they will open upon rotation of the cam 73 starting at 30° from top center (when the press ram is at the top of its stroke) and remain open until the cam has rotated 330°, or again 30° from top center, leaving the limit switches closed for a rotation interval of 60°.

So long as the solenoid 98 is energized, the air switch 96 remains open. In the event that the solenoid 98 is not energized upon 30° of crankshaft rotation, as for instance if no electric current passes to the press control relay coil, then the air switch 96 will remain closed and air will pass to the limit switches 118 and 128, and to the limit switch 164 at 90° of cam rotation.

For normal operation of the press 30, the operator must press both palm buttons 78,78 simultaneously, and must hold these palm buttons in switching contact for at least 180° of crankshaft operation. The length of time varies from press to press depending upon the speed of rotation of the crankshaft. In the event that one or the other, or both palm buttons are released prior to such 180° of crankshaft rotation, the press control holding relay coil will not be energized and the press clutch will declutch and normal conventional press braking action occur. However, the press will shut off through operation of air limit switches 118 and 128, the OR element 122, the NOT element 136 and the test switch 152, activating the pressure switch 156 and opening the emergency off-path circuit in the press control.

The air limit switches 112, 118, 128 and 164, though shown in part to one side of the framework 62 for greater visibility, are more usually located within the framework, substantially central of the shaft and adjacent the cam 73 on the press ram crank. Of course, cam location will vary, in accordance with press style and design.

The ram blocking device 16 is retracted and normal press operation resumed when the NOT element 160 is not charged with pressurized air in conduit 168. The spring in valve 12 then drives the valve spool back to its normal position, allowing compressed air from conduit 80 to pass into the conduit 44 and return the piston and piston rod 45 of air cylinder 14 to normal retracted position. The start button for press operation is then depressed and its switch closed. To "inch" the press ram downwardly and then upwardly to the top of its stroke, by means of the "inching" switch button, the test air switch 152 is disabled. The selector on the main press control panel is then set for "single stroke" operation, and normal single stroke operation can then be resumed.

In setting up the blocking device 16, the press ram 41 is first retracted to full top position by actuation of test air switch 142, and the ram blocking device 16 when extended is then adjusted in height to a dimension slightly or somewhat below the lower face of the elevated ram bolster plate 88. The lock nut 55 is then tightened upon the blocking screw 54 to maintain the adjusted blocking height. Whenever the ram shut height is adjusted, as for instance when a die set or tooling is changed, the blocking screw 54 should also be adjusted as above described. The adjusted blocking height of the device 16 is related to the shut height of the ram and to the ram stoke rate. The desired gap above the top surface of the blocking device 16 will vary in view of the shut height, the stroke speed of the ram, the speed of the piston rod 45 and the distance to be travelled by the blocking member 46. Persons skilled in the art to which the invention pertains are qualified to determine the preferred or required gap between the blocking screw 54 and the ram bolster plate 88.

The timer 102 is the "back-up" of the air logic components of the circuitry 20. Setting up the timer is relatively simple but of vital importance. The procedure and sequence for adjusting the timer 102 is as follows. The press controls are manually set and arranged for "single stroke" operation. The timer 102 is then manually adjusted so that indicators 110, 126 and 134 extinguish simultaneously with each cycle of the press. After the timer is adjusted, the time interval should be locked against possible inadvertent variation. The foregoing procedure for adjustment of the timer 102 should be repeated periodically in order to double-check and maintain the required time intervals for effective operation of the ram blocking device 16.

Some presses are equipped with air-operated palm button valves instead of electrically operated button switches. In such cases, the solenoid operated air switch 96 can be eliminated and air from such palm button valves will pass directly to the timer 102 via conduit 104.

Although a particular embodiment of the invention has been disclosed herein for purposes of explanation, further modifications or variations thereof, after study of this specification, will or may become apparent to those skilled in the art to which the invention pertains. Reference should be had to the appended claims in determining the scope of the invention.

I claim:

1. In a press ram blocking and control system for a press having a frame supporting a movable ram-affixed upper tool holding bolster plate and a lower die plate fixedly supported on said frame, means for reciprocatingly moving said ram-affixed upper bolster plate relative to said lower die plate, and press control circuitry to actuate and control said means to reciprocatingly move a frame supported ram, the improvement comprising in combination a fluid valve, a fluid cylinder communicating with said valve and having a reciprocatingly movable piston and piston rod actuated by operation of said valve, means securing said cylinder and valve to said press frame, a reciprocatingly movable blocking member for said upper bolster plate affixed to the distal end portion of said piston rod projecting from said fluid cylinder, fluid valve control means communicating with said valve and mounted on said press frame in association with and for actuation by said means for moving said upper bolster plate, and fluidic circuitry including said fluid valve, said fluid cylinder and said fluid valve control means responsive to a malfunction in normal press operation, whereby said blocking member is insertable between said movable upper bolster plate and said lower die plate in response to valve actuation of said fluid cylinder piston and piston rod upon the occurrence of malfunction in normal press operation.

2. The system defined in claim 1, wherein said fluid valve control means includes means and circuitry for testing said control means to detect a means or circuitry failure.

3. The system defined in claim 1, wherein said means for reciprocatingly moving said bolster plate comprises a motor driven crankshaft having a cam thereon, and said ram reciprocatingly movable in said frame, said upper bolster plate being affixed to the distal end of said ram, fluid switching components of said fluid valve control means being mounted on said frame for actuation by and upon predetermined rotation of said cam.

4. The system defined in claim 3, wherein said fluid valve control means comprises fluid actuated limit switches forming a part of said fluidic circuitry and mounted on said press frame in the rotating level path of said cam.

5. The system defined in claim 1, wherein said means for reciprocatingly moving said bolster plate comprises hydraulic power means, said ram being connected to and reciprocatingly movable in said press frame by said hydraulic power means.

6. The system defined in claim 5, wherein said fluid valve control means comprises fluid actuated limit switches forming a portion of said fluidic circuitry, means secured to said frame for mounting said limit switches in and adjacent the travel path of said ram-affixed bolster plate, and triggering means on said ram and bolster plate structure to actuate said limit switches in the reciprocating movement of said ram-affixed bolster plate.

7. The system defined in claim 6, wherein said means for mounting said fluid actuated limit switches to said press frame comprising an adjustable post upon which said limit switches are secured in operative posture relative to said triggering means.

8. The system defined in claim 1, wherein said means for reciprocatingly moving said bolster plate comprises air cylinder power means, said ram being connected to and reciprocatingly movable in said press frame by said air cylinder power means.

9. The system defined in claim 8, wherein said fluid valve control means comprises fluid actuated limit switches forming a portion of said fluidic circuitry, means secured to said frame for mounting said limit switches in and adjacent the travel path of said ram-affixed bolster plate, and triggering means on said ram and bolster plate structure to actuate said limit switches in the reciprocating movement of said ram-affixed bolster plate.

10. The system defined in claim 9, wherein said means for mounting said fluid actuated limit switches to said press frame comprises an adjustable post upon which said limit switches are secured in operative posture relative to said triggering means.

11. The system defined in claim 1, wherein said blocking member is aligned with respect to said lower die plate so as to move in a plane immediately above said lower die plate and come to rest thereon.

12. The system defined in claim 1, wherein said blocking member comprises a body portion and means adjustably mounted on said body and extendible upwardly therefrom, so that said blocking member is adjustable in height.

13. The system defined in claim 1, wherein said blocking member is adjustable as to its height by screw means threadedly mounted in said blocking member and extending upwardly from a surface thereof.

14. The system defined in claim 1, wherein said blocking member is provided with means preventing rotation of said blocking member in its reciprocating movement.

15. The system defined in claim 14, wherein said rotation-preventing means comprises a guide rod affixed to said blocking number and slidable in a bearing on said fluid cylinder.

16. The system defined in claim 14, wherein said rotation-preventing means comprises a guide rod affixed to said blocking member and slidable in a bearing on said frame.

17. The system defined in claim 1, wherein said fluidic circuitry is connected to, communicates with and is served by a fluid power source.

18. The system defined in claim 17, wherein a solenoid controlled fluid switch in said fluidic circuitry is connected to and in said press control circuitry.

19. The system defined in claim 1, wherein said fluidic circuitry comprises the circuitry disclosed herein and illustrated in FIG. 9 of the drawings.

20. The system defined in claim 19, wherein said fluidic circuitry operates on compressed air as the actuating fluid.

* * * * *